US008656966B2

(12) United States Patent
Copland et al.

(10) Patent No.: US 8,656,966 B2
(45) Date of Patent: Feb. 25, 2014

(54) YARD WASTE BAG BUTTLER

(76) Inventors: John Copland, Barrie (CA); Lesley Copland, Barrie (CA)

( * ) Notice: Subject to any disclaimer, the term of this patent is extended or adjusted under 35 U.S.C. 154(b) by 221 days.

(21) Appl. No.: 13/229,801

(22) Filed: Sep. 12, 2011

(65) Prior Publication Data

US 2012/0174535 A1 Jul. 12, 2012

Related U.S. Application Data

(60) Provisional application No. 61/432,052, filed on Jan. 12, 2011.

(51) Int. Cl.
*B65B 1/04* (2006.01)

(52) U.S. Cl.
USPC ..... 141/316; 383/34; 141/14; 141/337

(58) Field of Classification Search
USPC ..... 53/472; 383/33, 34; 141/114, 10, 313, 141/314, 316, 337, 390, 391
See application file for complete search history.

(56) References Cited

U.S. PATENT DOCUMENTS

| | | | | | |
|---|---|---|---|---|---|
| 4,890,652 | A * | 1/1990 | Hoerner | ..... | 141/10 |
| 4,979,547 | A * | 12/1990 | Hoerner | ..... | 141/390 |
| 5,129,609 | A | 7/1992 | Tobin | | |
| 5,716,138 | A * | 2/1998 | Southwell | ..... | 383/104 |
| 5,897,084 | A * | 4/1999 | Judge | ..... | 248/95 |
| 6,536,488 | B1 * | 3/2003 | Pochobradsky | ..... | 141/390 |
| 6,708,742 | B2 * | 3/2004 | Weathers et al. | ..... | 141/391 |
| 6,866,070 | B2 | 3/2005 | King | | |

* cited by examiner

*Primary Examiner* — Jason K Niesz
(74) *Attorney, Agent, or Firm* — Daniel Boudwin; Global Intellectual Property Agency LLC

(57) ABSTRACT

A yard waste bag device is provided having a rectangularly tubular structure with rounded lower edges, adapted to maintain a bag opening while loading contents therein. The device comprises two open ends, a hollow interior and rotating corners adapted to allow a condensed, folded configuration for storage. A user may slide this assisting device into a yard waste bag in order to maintain the bag opening, whether in a vertical or horizontal position. Once the yard waste bag is full, the assisting device may be removed and stored. There is a designated marker within the device to identify the fill mark for the bag to prevent overfilling. A handle may be provided in the top edges of the device to facilitate removal of the device once the bag has been filled. The lower edges of the device are rounded to facilitate smooth entry into a yard waste bag.

10 Claims, 3 Drawing Sheets

YARD WASTE BAG BUTTLER

CROSS REFERENCE TO RELATED APPLICATION

Figure 3:
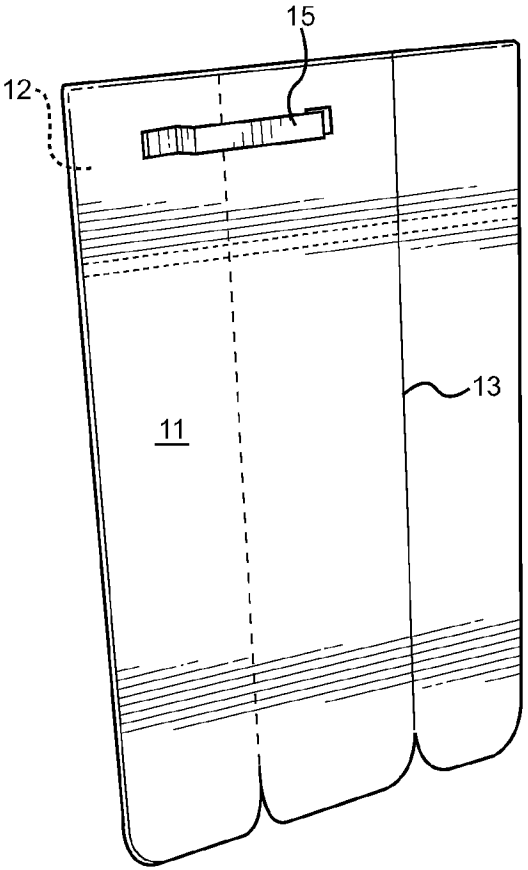

This application claims the benefit of U.S. Provisional Application No. 61/432,052 filed on Jan. 12, 2011, entitled "Yard Waste Bag Butler."

BACKGROUND OF THE INVENTION

1. Field of the Invention

The present invention relates to a yard waste bag assisting device that allows for both an upright and horizontal usage of a waste bag as well as allowing access to a capacity line and the ability to be cleaned easily.

Yard waste removal is a task that homeowners complete on a consistent basis. Typically, it is required that a special waste collection bag, or yard waste bag, is used for pickup of yard waste. Hardware and convenience stores generally sell paper yard waste collection bags that are compliant with regulations governing disposal and recycling of yard waste. These yard waste bags are normally unsupported articles that are difficult to load while simultaneously handling yard tools. This problem arises when these bags are used by a single individual. The problem is created because an individual has to collect the leaves, hold open the bag and put the leaves in the bag simultaneously, and while utilizing a yard tool to collect the leaves or rake them into the bag opening. Inevitably, the bag opening collapses because the bags are unstable on their own, and the user needs to take additional time and utilize an awkward body position in order to individually complete the task of filling the waste bag. Requesting help of another person is not always plausible or desirable for either party, therefore individuals are commonly faced with these problems associated with yard waste collection. Yard waste itself may include items such as decaying plants and pet waste that if not removed properly can increase the risk of potential scavenger animals, bacterial and germs. Another common problem during this exercise is that too much waste is put into a single bag, leaving the user needing to pull out some of the waste because the bag may become overfilled. A device is required that solves these common problems and provides a user with a convenient tool for filling yard waste bags, along with a structure that is suited for use with waste materials.

There are many existing apparatuses for aiding in the control and management of yard waste bags. These apparatuses include means to attach the bag to an insert in order to keep them upright. These apparatuses involve support of multiple types of trash bags, and further involve some type of lengthy assembly. Yard waste bags differ from a typical trash bag, due to local municipality requirements for waste collection and overall size of the bag, therefore a specific tool is required to operate with such bags.

The present invention solves these problems by providing a means for filling waste bags whether in a vertical upright position or in a horizontal position. It also provides a means to easily remove, reduce and store the device. A capacity line that is located within the assisting device allows the user to view the recommended waste level that would allow a filled bag while still allow closure of its upper region, solving the problem of overflow. Alternatively, an elongated aperture is located along the length of the present invention to allow visualization of the bag's internal fill line. A handle is attached to the exterior of the device to allow efficient removal thereof from a filled bag. The lower edges of the device employ rounded corners to facilitate easy insertion into a yard waste bag interior prior to use. The device further is made of a material suitable for waste collection, such as corrugated plastic or some other material that can be easily cleaned periodically.

2. Description of the Prior Art

The prior art contains a variety of waste bag support insert devices for positive retainment and support of collapsible bags. These devices have familiar design and structural elements for the purposes of supporting collapsible bags; however they are not structured for horizontal use, take into account the cleaning of the device and the need for a specific type of bag that is used for yard waste with an internal fill line.

U.S. Pat. No. 6,866,070 to King discloses a waste bag insert wherein the bag insert is placed inside the waste collection bag and then expanded. Once expanded, the bag insert maintains the bag in an upright and open position. Pegs are attached to the bottom to allow a user to force the pegs into the ground to maintain an upright open position. The pegs do not allow for horizontal use of the product. Handles are located on two sides of the insert. These handles, or more precisely, hand holds, are the type that provides an open space for a user's hand to enter and hold onto the device. This can be unpleasant for the user due to the fact that the inside of the insert will have waste collected therein, allowing contact with the user while grasping the handles.

U.S. Pat. No. 4,890,652 to Hoerner describes a sleeve that is unfolded to form an open ended sleeve closed on its sides. The sleeve is adapted to positively retain and support a collapsible bag at the top by providing narrow slits at the corners to hold the bag material. The sleeve generally has the same length from top to bottom as the length of the bag. Hand holds are provided in the top edges of the sleeve to facilitate removal of the sleeve from the full bag. These hand holds are similar to that provide in the King patent, which are less than ideal given the contact risk with collected waste while operating the handles.

U.S. Pat. No. 4,979,547 to Hoerner describes another trash bag expander device that is similar to the '652 patent, except for the addition of laminated water repellant adhesive to the internal panels and moisture resistant compound coating the inside of the sleeve for protection of inside of the collapsible bag. This coating helps to prevent moisture from damaging the device, but it does not focus on the ability to wash and clean the device which is necessary if used multiple times.

U.S. Pat. No. 5,129,609 to Tobin is another trash bag support apparatus that describes a device with a ridged flat back and sides that extend out to widen the bag that is placed over it. The device has slots where a trash bag can be held in place while using this particular device. The back may include an extension to serve as a backboard. The surface may be coated with a waterproofing substance to protect from damage. Hand holds are used similar to the above patents for removal of support apparatus. This can be unpleasant for the user due to the fact that the inside of the insert will have waste collected.

U.S. Pat. No. 5,897,084 to Judge is another trash bag expander device that describes a tubular expander for a trash bag. The panels are stiff in character because the invention is intended to hold the bag upright. Retainers such as slits near a top edge of the form can be used to pinch the upper edge of the bag in place. Each panel is of equal size. Hand holds are near the top edge. Again, hand holds create an unpleasant feeling for the user due to the fact that the inside of the device will have waste collected.

The devices disclosed in the prior art do not address the need for the flexibility to use the device either standing up or lying on its side. The current invention relates to a device that allows a user to fill while the device is lying down in the horizontal position or while the device is standing in the upright position. The current invention also relates to a device that allows for use with yard specific waste bags that provide capacity fill levels for the bag to prevent overfilling thereof. The interior of the device provides a fill level, or alternatively a means to visualize the fill level on the yard waste bag interior surface. Its material is specifically intended for rigidity, durability and one that is easily cleanable. The structure and intent of the present invention substantially diverges in design elements from the prior art and consequently it is clear that the present invention is not described by the prior art and that a need exists for an improved yard waste bag insert that provides an efficient method of removing waste material without overfilling the associated waste bags. In this regard the instant invention substantially fulfills these needs.

SUMMARY OF THE INVENTION

In view of the foregoing disadvantages inherent in the known types of yard waste bag supports now present in the prior art, the present invention provides a new means to support the collection of waste wherein the same can be utilized for providing convenience for the user when used either in the horizontal or vertical position.

It is therefore an object of the present invention to provide a new and improved yard waste support device that has all of the advantages of the prior art and none of the disadvantages.

Another object of the present invention is to provide a new and improved yard waste support device that can be used in the vertical or horizontal position.

Yet another object of the present invention is to provide a new and improved yard waste support device with a capacity level indicator to prevent overfilling of the yard waste bag.

Still another object of the present invention is to provide a new and improved yard waste support device that is made of a material that is easily cleanable and of durable construction.

Another object of the present invention is to provide a new and improved yard waste support device that is made with an attached handle on the outside to prevent user from having to come in contact with accumulated waste.

A final object of the present invention is to provide a device with rounded lower edges to improve insertion into a yard waste bag, preventing snaring or snagging of the bag while inserting and prior to use.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

Figure 1:
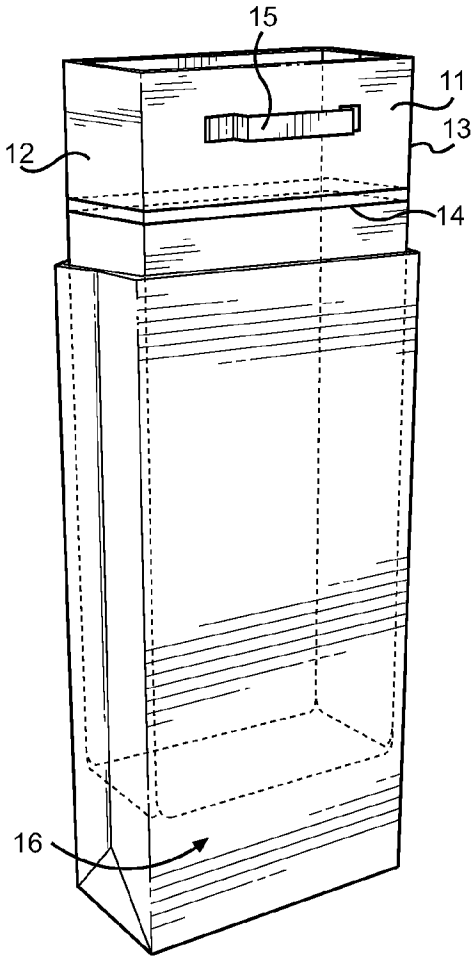

FIG. 1, shown is a perspective view of a preferred embodiment of the present invention in the expanded position. The device is shown standing alone.

Figure 2:
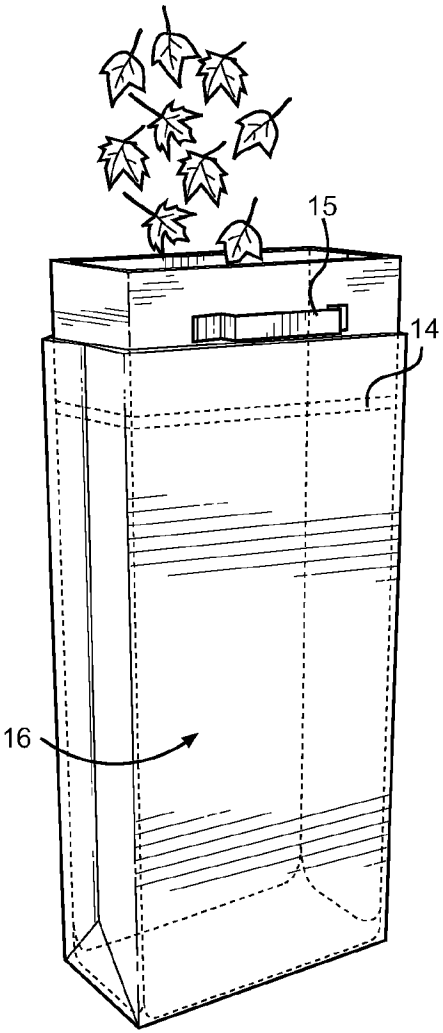

FIG. 2, shown is a perspective view of a preferred embodiment of the present invention in use. The yard waste bag assisting device and surrounding bag is filled from above.

FIG. 3, shown is a perspective view of the yard waste assisting device being folded into a condition for storing.

Figure 4:
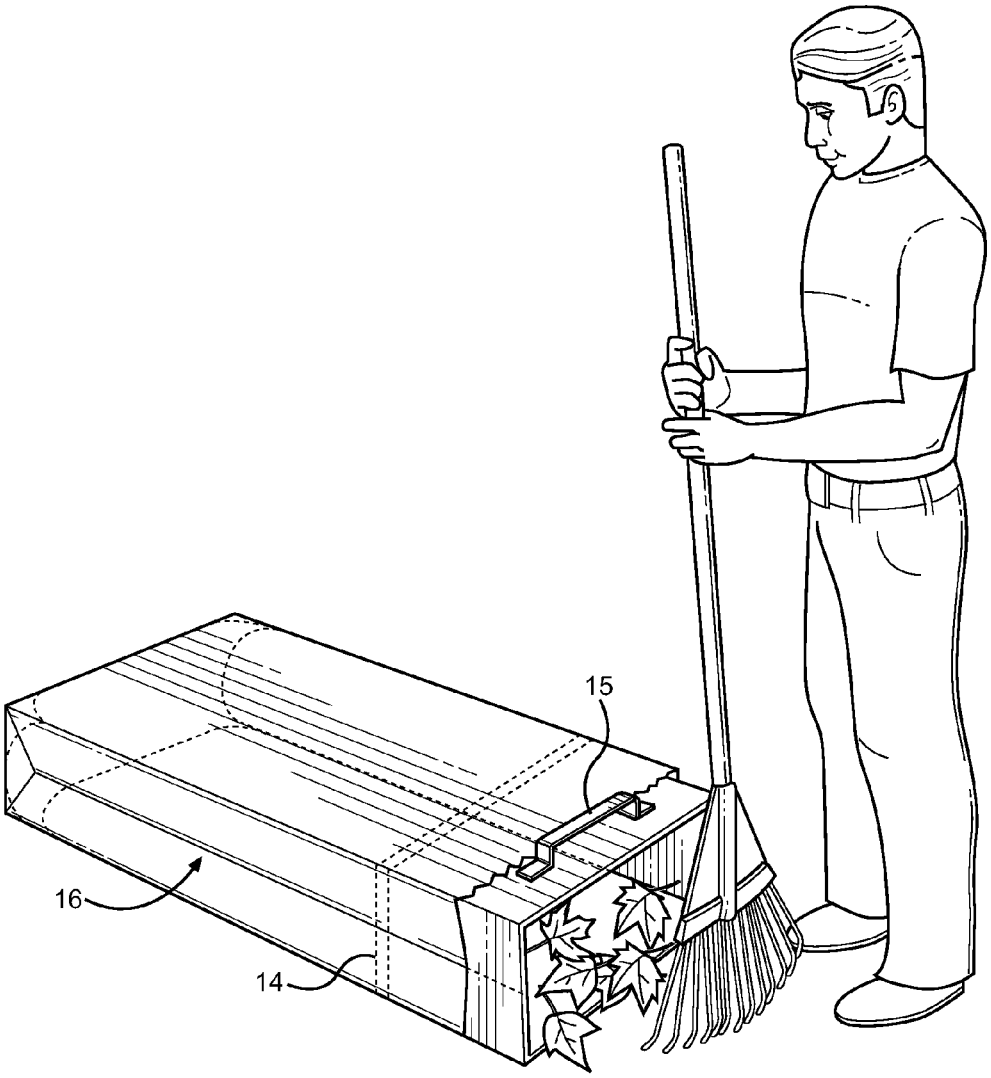

FIG. 4, shown is a perspective view of a preferred embodiment of the present invention in use. The yard waste bag assisting device is in its horizontal position. A waste bag is surrounding the yard waste bag assisting device. A user rakes waste into the bag without the need to hold the bag or hold the assisting device.

Figure 5:
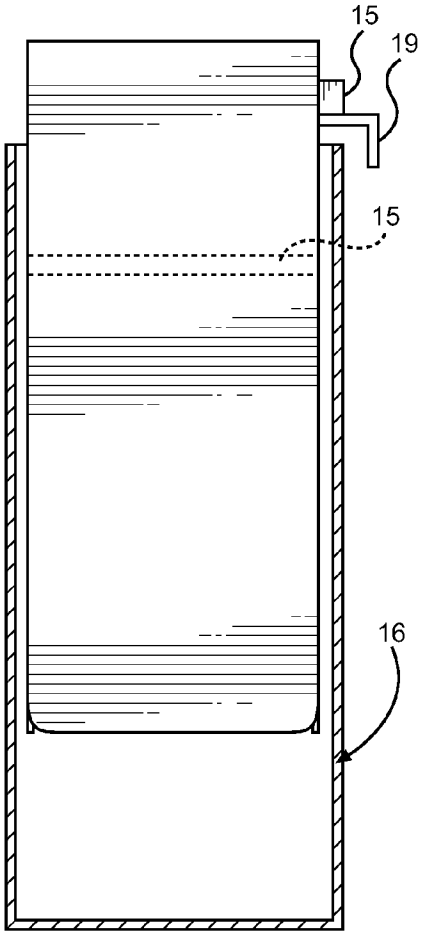

FIG. 5, shown is a side view of an alternate embodiment of the present invention.

Figure 6:
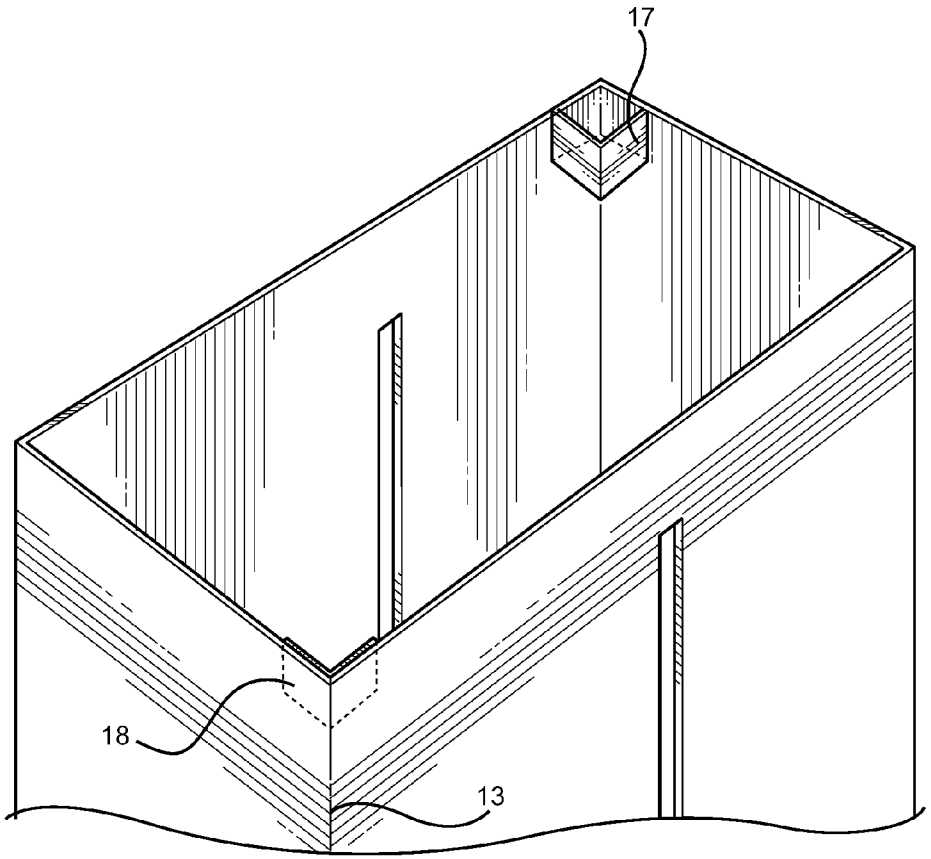

FIG. 6, shown is a partial perspective view showing lockable hinges on the corners being set in place on the form in position for use.

DETAILED DESCRIPTION OF THE INVENTION

Referring now to FIG. 1, there is shown the yard waste bag assisting device of the present invention in a fixed, expanded and upright position and positioned within the interior of a yard waste bag 16. The device defines four panels in which a rectangular form structure with an open interior volume and two open ends is produced. There is a front panel 11, a rear panel and two side panels 12. The form is sturdy enough to be self-supporting in an open position, in either an upright or horizontal position while being utilized. Four longitudinal fold lines 13 along the edges of each panel define where one panel may be folded onto another panel to collapse the interior volume of the device into a collapsed state, or vice versa unfolded into a working state. The lower end of the device, adapted for insertion into a yard waste bag, is provided with rounded corners to facilitate insertion of the device into the opening of a yard waste bag prior to use. The interior surface of the device includes a marking region 14 that correlates to the capacity fill line of the yard waste bag. The interior surface of the device includes a line that correlates to the capacity fill line of the yard waste bag for the preferred embodiment of the marking region. An alternate embodiment of the device contains a marking region that comprises a vertical slit that runs longitudinally down along the front panel 11 so as to show the actual capacity fill line on the yard waste bag interior surface. The device further includes a handle 15 located on the front panel 11, generally near the upper edge and centered thereon. An alternate embodiment of the handle includes a notch that keeps the distance between the upper edges of the bag to the marking region consistent using different sized bags. The upper edge of the bag rests against the notch to prevent dislocation or relatively movement while in use. The handle 15 may be made of the same material as the rest of the device. The practitioner may further use the handle 15 to remove the device from a waste bag, eliminating any contact with yard waste with his or her own hands. This saves the user from the unpleasantness of having to needlessly make contact or grab yard waste while operating the device.

Referring now to FIG. 2, there is shown the yard waste bag assisting device expanded and placed in an upright position for use. The device is in a fixed, open position with a yard waste bag 16 covering the lower portion of the device, generally as it appears during use. The user is able to fill the interior volume of the device and yard waste bag 16 by first placing the device in the interior cavity of the waste bag 16 and retaining its opening in a working position. Yard waste can then be placed within the bag 16 until filled to a marking region 14, as indicated on the device interior surface or as visualized on the bag interior through a vertical slit along the sides of the device. The device supports the bag 16 in the open position, wherein the yard waste bag 16 and assisting device are both supportable in a standalone position.

Referring now to FIG. 3, there is shown a yard waste bag assisting device as described by the present invention folded into a collapsed state. The longitudinal fold lines 13 that form the corners of the device enable the form to be folded into a flat configuration that facilitates storage, ease of moving and ease of entry into an opened bag. The lower ends of the panels forming the device incorporate rounded corners to facilitate insertion of the device into the opening of a yard waste bag prior to use. The rounded corners are superior to pointed corners, which would snag or catch the bag opening during insertion.

Referring now to FIG. 4, there is shown the yard waste bag assisting device in use in its horizontal state. The device is in a fixed, open position with a waste bag 16 surrounding the device. The yard waste bag 16 is held open by the device, allowing the user to rake or fill the device while standing, without having to adjust the yard waste bag 16 in the process or resort to an uncomfortable posture to support the waste bag 16 while raking waste therein. A marking region 14 is defined in the drawing as a capacity fill line shown along the interior of the device to assist the user in identifying when the yard waste bag is full, or alternatively a vertical slit is provided for the user to visualize a fill line along the bag interior. Filling the bag 16 to this level 14 allows for proper closure of the bag, while filling the bag to its maximum capacity.

Referring now to FIG. 5, there is shown a side view of the yard waste bag assisting device in its upright position and in a working position. The device is in a fixed, open position with a yard waste bag 16 covering the lower portion of the device, generally as it appears during use. The device supports the bag 16 in the open position, wherein the yard waste bag 16 and assisting device are both supportable in a standalone position. A latch 19 protrudes from an underside of the handle 15, allowing the assisting device to rest on the edge of the yard waste bag 16, securing its position while in use. The marking region 14, shown as the capacity fill line, provides notice of when the yard waste bag 16 has reached its capacity or alternatively a vertical slit is provided for the user to visualize a fill line along the bag interior.

Referring now to FIG. 6, there is shown the yard waste bag assisting device utilizing a locking means and an alternate embodiment of the marking region. Locking hinges 17, 18 are used that when placed in a working position, the hinges are locked in place and hold the form device in an open position for vertical or horizontal use. The locking hinges 17, 18 prevent the device from folding onto itself during operation. These are located on the corner edges of the device, either at all four corners or at opposing corners. The locking hinges comprise two joined surfaces that form a box pop hinge, wherein the surfaces are pressed into the device corner 13 to prevent collapsing or rotation thereof. The surfaces of the hinges 17, 18 form a corner 13 with a slightly increased dimension, placing a strain on the device corner 13 when in a locked position. When in an unlocked position, corner 13 of the device is free to rotate and the locking hinge may fold flat against itself. FIG. 6 there is shown the fully locked position of the locking hinge 18 in the forefront of the drawing and an unlocked position 17 in the back corner of the device. The marking region in this embodiment of the device utilizes a vertical slit 20 that allows through-vision of the inner surface of the waste bag 16 when placed therein, permitting a fill line imprinted thereon to be viewed without removing the form.

In use, an individual opens the yard waste bag assisting device into its open position. While holding its handle 15, the user slides a yard waste bag 16 over the device. The bag sits below the handles when in the proper position, allowing access to the handles from outside of the device and above the collected yard waste. The device can alternatively be placed within the bag 16 in a folded state and unfolded to expand the bag interior. Once placed within the bag, the device is positioned in an upright or horizontal position to allow entry of waste contents. The user then fills the yard waste bag up to the capacity line, indicating that the yard waste bag is full and ready for closure. The user then removes the yard waste bag assisting device and can close the yard waste bag opening. The yard waste bag assisting device can then be inspected and cleaned if necessary. Once the yard waste bag assisting device is ready to be stored, the device may be folded into a smaller size which is easier to move and store. The device is designed to be reusable and easily cleanable using a garden hose or similar spray means. To this end, the device is preferably constructed of a durable plastic or corrugated material that will ensure longevity and easy clean up.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim the following:

1. An insert form for supporting the interior of a yard waste bag during the process of filling said bag, said insert comprising:

four similarly shaped and substantially rigid panels jointed along elongated edges to form a rectangularly tubular structure with open ends at respective top and bottom edges, said four similarly shaped panels comprising a front panel, rear panel, and two side panels, said rectangular tubular structure having foldable hinges that are lockable in the open position;

said panels being mutually foldable at said hinge between each two adjacent panels so that said structure may be folded into a flat condition, said insert having a marking region that designates when the yard waste bag is full, and said marking region comprising slit along said side panels to allow viewing of capacity line on yard waste bag.

2. The device of claim 1, wherein a handle is fastened to the insert and located at an upper portion of front panel of said device.

3. The device of claim 2, wherein said handle includes a notch that allows said insert form to rest on yard waste bag.

4. A device as in claim 1, wherein said panel top edges adapted to sit above said bag opening, allowing grasping of said top edges without contacting bag waste contents.

5. The device of claim 1, wherein said insert is formed from plastic material.

6. The device of claim 1, wherein said panels' lower edges comprise rounded edges to facilitate entry into an open yard waste bag.

7. An insert form for supporting the interior of a yard waste bag during the process of filling said bag, said insert comprising:

four similarly shaped and substantially rigid panels jointed along elongated edges to form a rectangularly tubular structure with open ends at respective top and bottom edges, said four similarly shaped walls comprising a front panel, rear panel, and two side panels, said rectangular tubular structure having foldable hinges that are lockable in the open position;

said panels being mutually foldable at said hinge between each two adjacent panels so that said structure may be folded into a flat condition, a marking region that designates when the yard waste bag is full, wherein said marking region comprises a slit along said side panels to allow viewing of capacity line on yard waste bag, a handle is fastened to the insert and located at an upper portion of front panel of said device.

8. The device of claim 7, wherein said handle includes notches that allow said insert form to rest on yard waste bag.

9. A device as in claim 7, wherein said panel top edges adapted to sit above said bag opening, allowing grasping of said top edges without contacting bag waste contents.

10. The device of claim 7, wherein said insert is formed from plastic material.

* * * * *